United States Patent [19]

Stultz

[11] Patent Number: 5,047,611

[45] Date of Patent: Sep. 10, 1991

[54] METHOD FOR SELECTIVELY CURING A FILM ON A SUBSTRATE

[75] Inventor: Timothy J. Stultz, San Jose, Calif.

[73] Assignee: Peak Systems, Inc., Fremont, Calif.

[21] Appl. No.: 499,913

[22] Filed: Mar. 23, 1990

[51] Int. Cl.[5] ..... F27B 5/14; F27D 11/02

[52] U.S. Cl. ..... 219/405; 427/55

[58] Field of Search ..... 219/405, 411, 390; 392/416, 419, 424, 308, 418; 427/55, 38, 74, 167

[56] References Cited

U.S. PATENT DOCUMENTS

| | | | |
|---|---|---|---|
| 2,824,943 | 2/1958 | Laughlin . | |
| 3,249,741 | 5/1966 | Mills . | |
| 4,575,616 | 3/1986 | Bergendal . | |
| 4,665,306 | 5/1987 | Roland et al. . | |
| 4,680,450 | 7/1987 | Thorson | 219/411 |
| 4,755,654 | 7/1988 | Crowley | 219/405 |
| 4,820,906 | 4/1989 | Stultz | 219/405 |

*Primary Examiner*—Teresa J. Walberg

*Attorney, Agent, or Firm*—Townsend and Townsend

[57] ABSTRACT

A method for rapidly curing a film on a substrate by selective heating, causing it to cure from the inside out. This is accomplished by illuminating the sample with a light source having a peak wavelength which will be primarily absorbed by the underlying substrate and is transparent to the overlying film. Thus the substrate will be selectively heated first by direct absorption of the radiation, and the film to be cured will in turn be heated by conduction from the substrate. In this way, the film will be cured from the interior interface to the surface, or from the inside-out.

5 Claims, 7 Drawing Sheets

METHOD FOR SELECTIVELY CURING A FILM ON A SUBSTRATE

The related application filed concurrently herewith is entitled "A Method for Selectively Heating a Film on a Substrate".

BACKGROUND

The present invention relates to methods for rapidly curing a film on a substrate through selective heating. One example would be the creation of an insulating layer, such as $SiO_2$, on a standard integrated circuit. The film is applied to the integrated circuit in a liquid form. Following application, the film needs to be cured using heat to convert it to a solid form. The curing process in general involves the driving out of volatile molecules or atoms. Using a conventional furnace which heats by convection, this is done at relatively low temperatures over long times to permit the diffusion and escape of the volatiles from the film as it is being cured. Since materials being heated convectively heat from the outside in, the surface of the film begins to cure before the interior. This cured layer subsequently impedes the escape or diffusion of the volatiles from the remaining uncured film. Under extreme conditions, the volatiles can be prevented from escaping and can agglomerate, forming pockets or voids within the film which reduce the effectiveness of the film. This effect occurs sooner if high temperatures are used. Consequently it is necessary to process the films at low temperatures and for long times to allow the curing process to proceed to completion without degradation of the desired film properties.

SUMMARY OF THE INVENTION

The present invention is a method for rapidly curing a film on a substrate by selective heating, causing it to cure from the inside out. This is accomplished by illuminating the sample with a light source having a peak wavelength which will be primarily absorbed by the underlying substrate because the overlying film is transparent to the light. Thus the substrate will be selectively heated first by direct absorption of the radiation, and the film to be cured will in turn be heated by conduction from the substrate. In this way, the film will be cured from the interior interface to the surface, or from the inside-out.

In one embodiment, the substrate will be silicon and the film would be a dielectric insulator initially in liquid form, such as a spin-on-glass (SOG). The light source is a gas discharge lamp filled primarily with xenon, which has a peak emission at a wavelength which will be absorbed by silicon because the SOG is transparent for that wavelength.

A process using the present invention can completely cure a film in seconds or minutes compared to the hours typically used in prior art. Further, because of the inside-out nature of the curing, more complete curing of the film and elimination of the undesirable volatiles can be achieved.

For a further understanding of the nature and advantages of this invention, reference should be made to the ensuing description taken in conjunction with the accompanying drawings.

DETAILED DESCRIPTION OF THE PREFERRED EMBODIMENT

Figure 1:
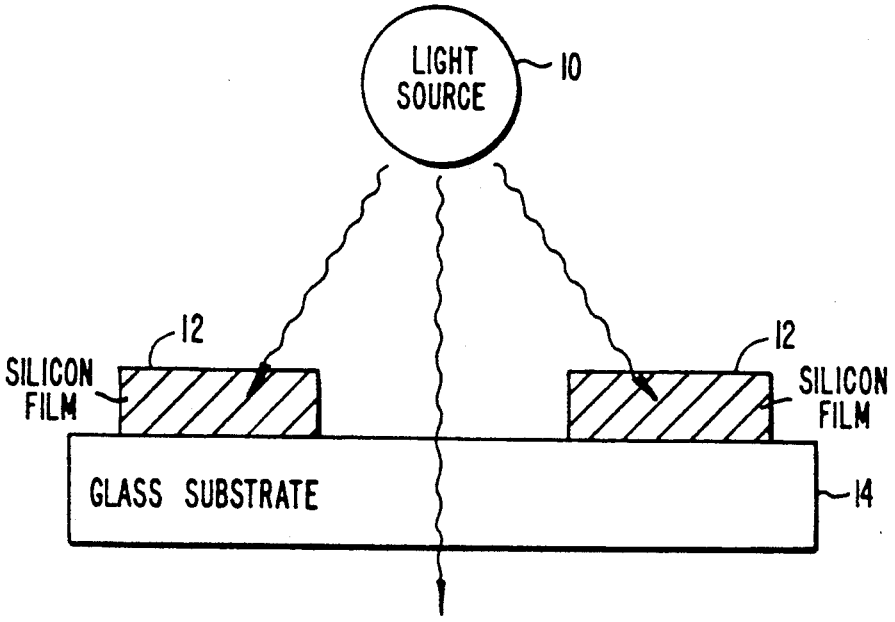
FIG. 1A is a diagram of a film on a substrate being cured according to the present invention.
FIG. 1B is a chart of temperature versus time showing a typical two-step process using the present invention.

FIG. 1A shows a light source 10 illuminating a film 12 and a substrate 14. Impurities 13 in film 12 are shown migrating their way to the surface during a curing process. Light source 10 is chosen to emit radiation having a wavelength which will be absorbed by substrate 14, but not by film 12. As substrate 14 becomes heated, film 12 is heated as well by thermal conduction, with the heating starting at the interface between the film 12 and substrate 14. By heating from the inside-out, rather than from the outside-in, the curing or crusting of the outside first, which would trap volatile atoms, is avoided.

One example of the light source is set forth in U.S. Pat. No. 4,820,906, incorporated herein by reference. In one embodiment, the light source is a long-arc gas-discharge lamp filled primarily with xenon, and substrate 14 is silicon. The energy of xenon at its peak emission wavelength is greater than the energy band gap of silicon, and thus will be absorbed by the silicon substrate. The energy of xenon is less than the energy band gap of the film 12, which may be spin-on glass, for instance, so that it will not be absorbed.

A chamber which can be used for holding the specimen is shown in U.S. Pat. No. 4,755,654, which is incorporated herein by reference. An inert tray is used to hold a large number of samples in one embodiment.

FIG. 1B is a diagram of a typical process using the present invention. The specimen would first be heated to a first, relatively low temperature (typically 400°–600° F.) for typically 5–30 seconds. The use of this lower temperature allows the temperature gradient to spread from the substrate through the film. A much higher temperature would essentially heat the entire film so fast that the gradient between the substrate interface and the outside of the film would not be sufficient to keep volatile atoms from being trapped.

After this first, relatively low temperature step, the temperature can be increased to typically 900°–1000° F. to complete the curing process after the volatile atoms have had a chance to escape. Typically, this second step will be for 2–20 seconds.

Figure 2A:
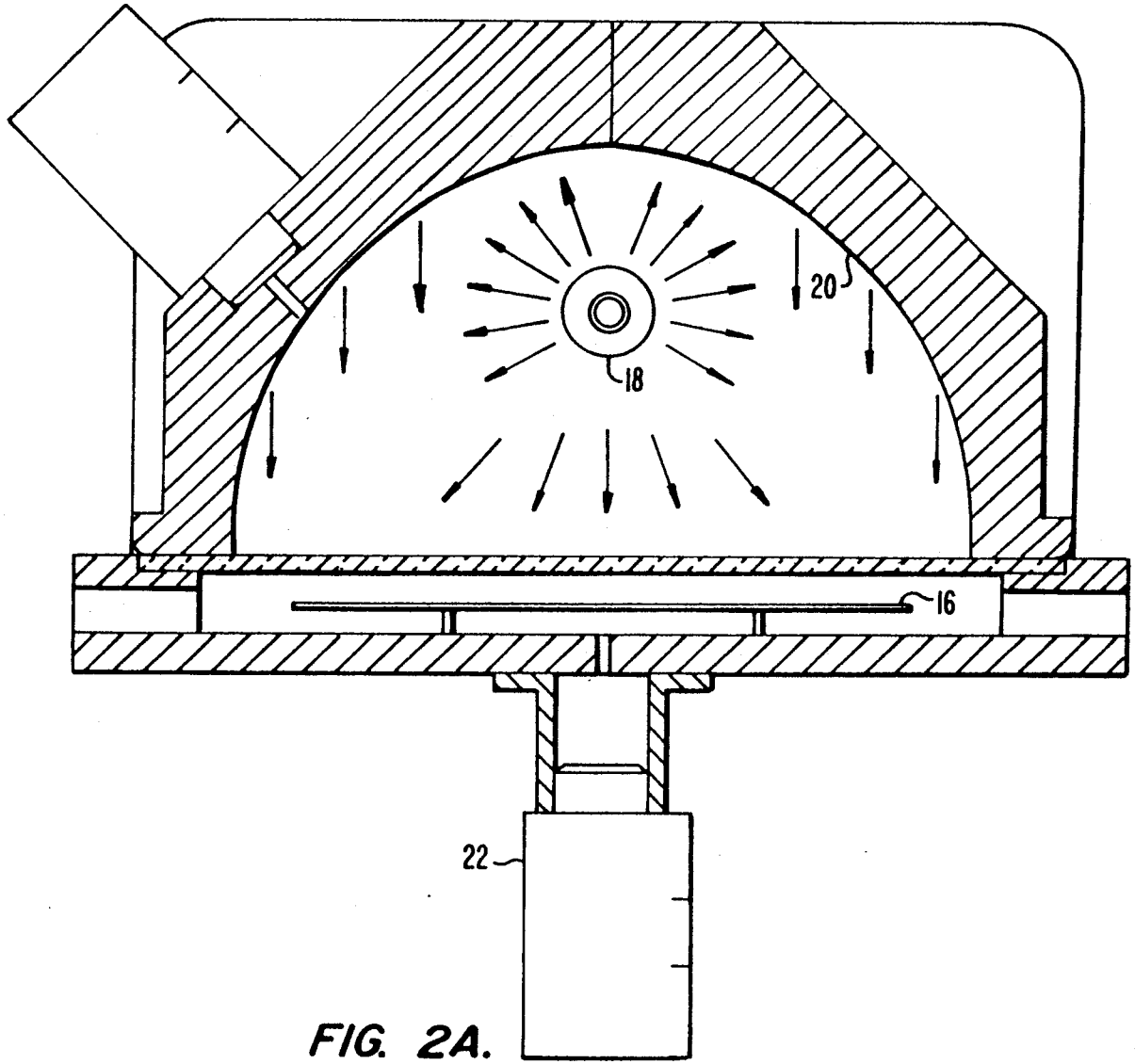
FIGS. 2A and 2B are front and side views of an embodiment of the present invention using total illumination of the substrate.
Figure 2B:
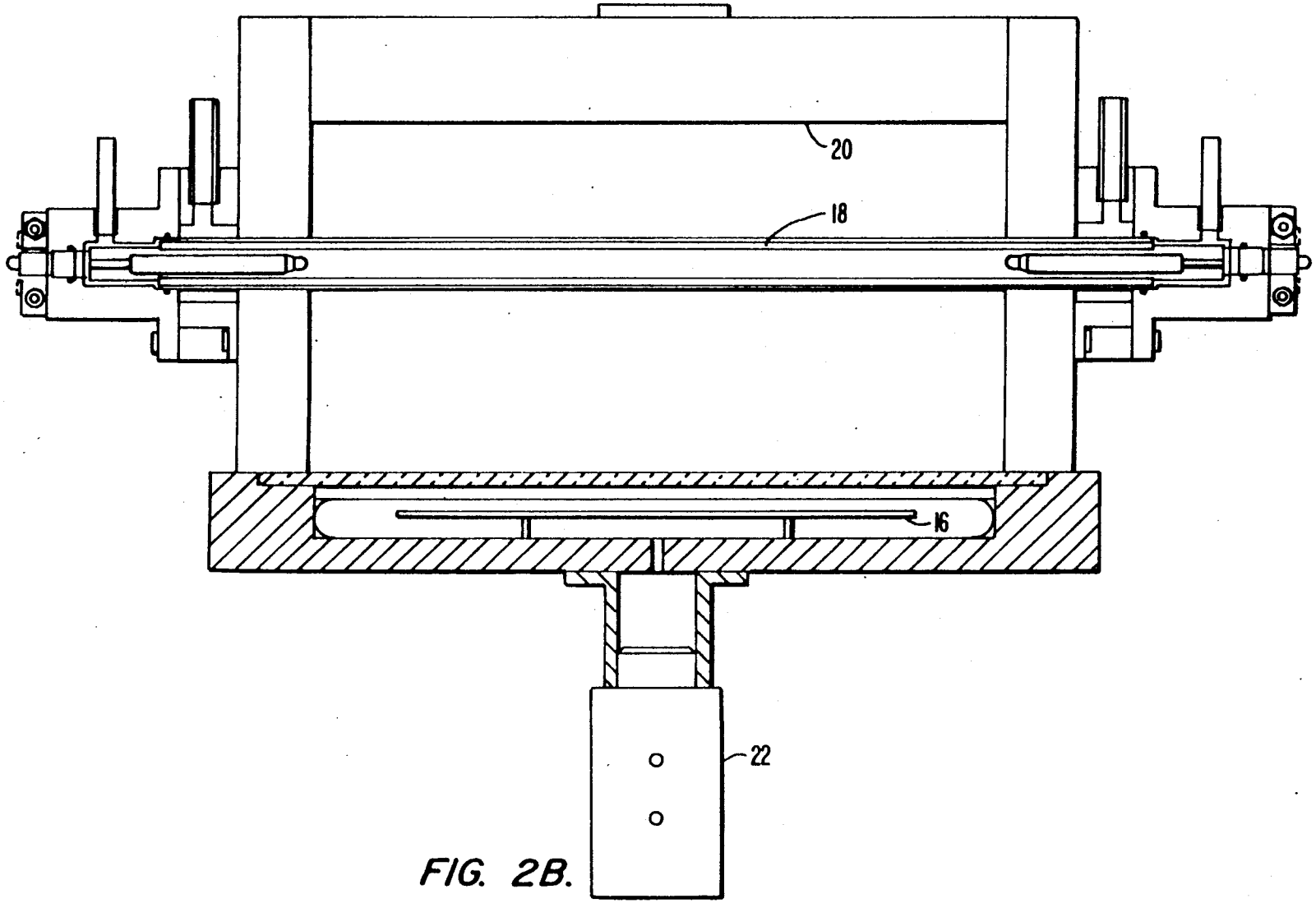

FIGS. 2A and 2B are front and side views of the arrangement shown in more detail in the '654 patent. The specimen 16, consisting of the film and substrate, is placed beneath a light source 18. A reflector 20 above the light source concentrates light on the specimen 16. A pyrometer 22 beneath the specimen 16 detects the infrared light given off by the specimen as it is heated, and provides feedback to the controls for the light source.

Figure 3:
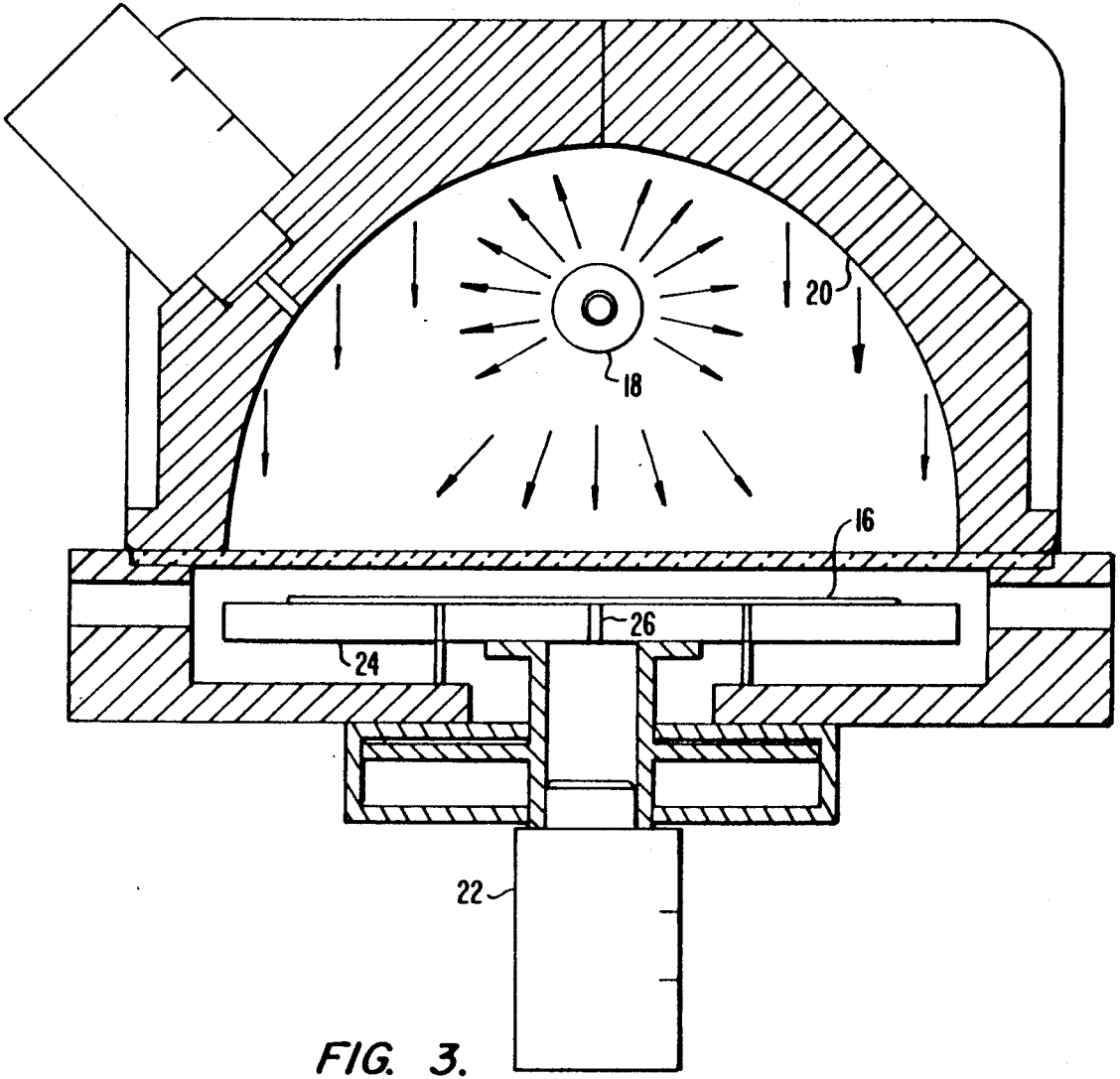
FIG. 3 is a diagram of the embodiment of FIG. 2A with a heat sink.

FIG. 3 shows a similar arrangement with the addition of a heat sink 24. A through-hole 26 is provided in the center of the heat sink so that pyrometer 22 can view specimen 16. In one embodiment, the heat sink is metal and is water cooled. Because the substrate 14 will be in contact with the heat sink, this will further aid in keeping the substrate cool while allowing the film 12 to heat.

Figure 4A:
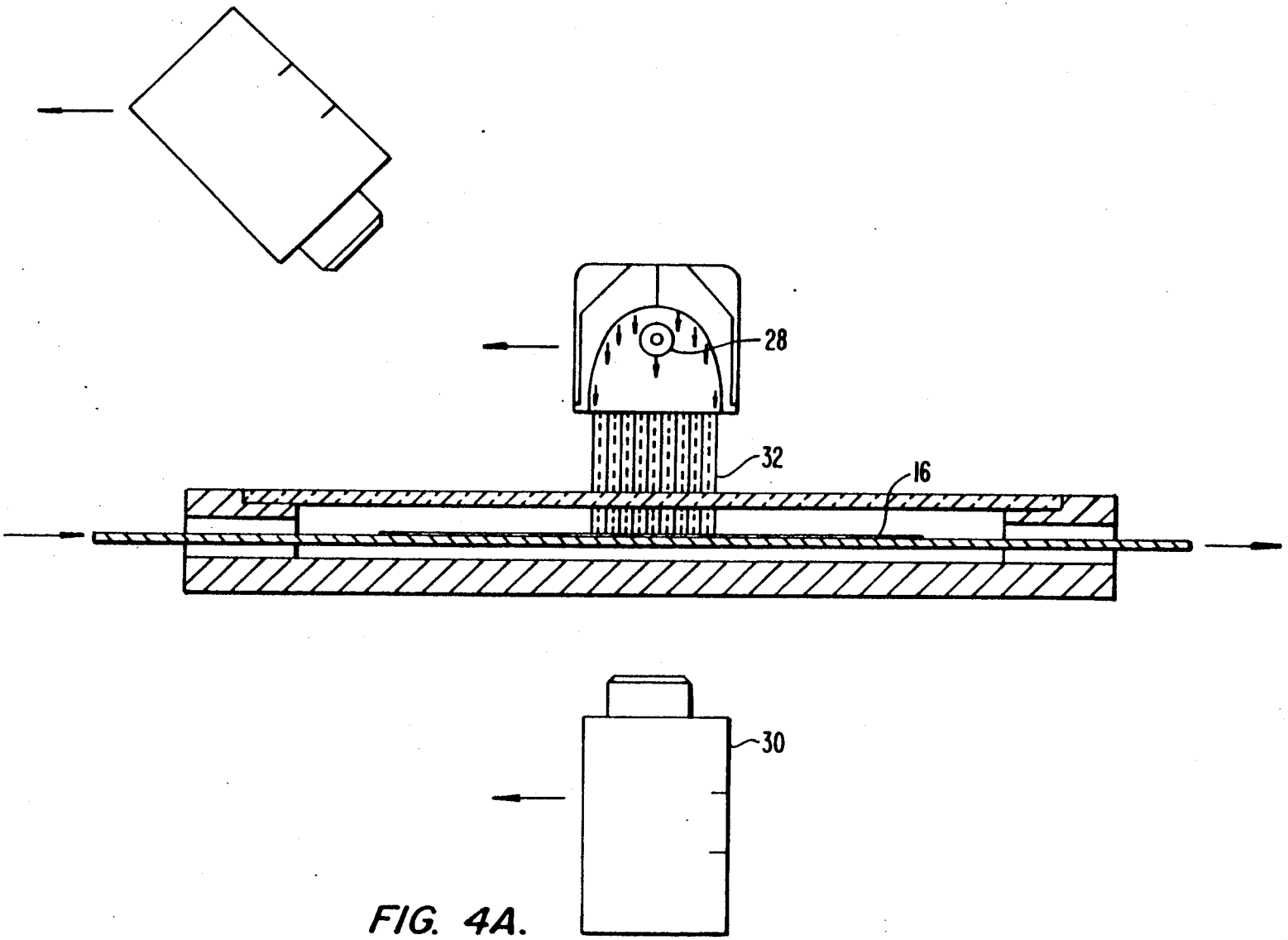
FIGS. 4A and 4B are front and side views of an embodiment of the present invention in which a scan line of light is moved across the substrate.
Figure 4B:
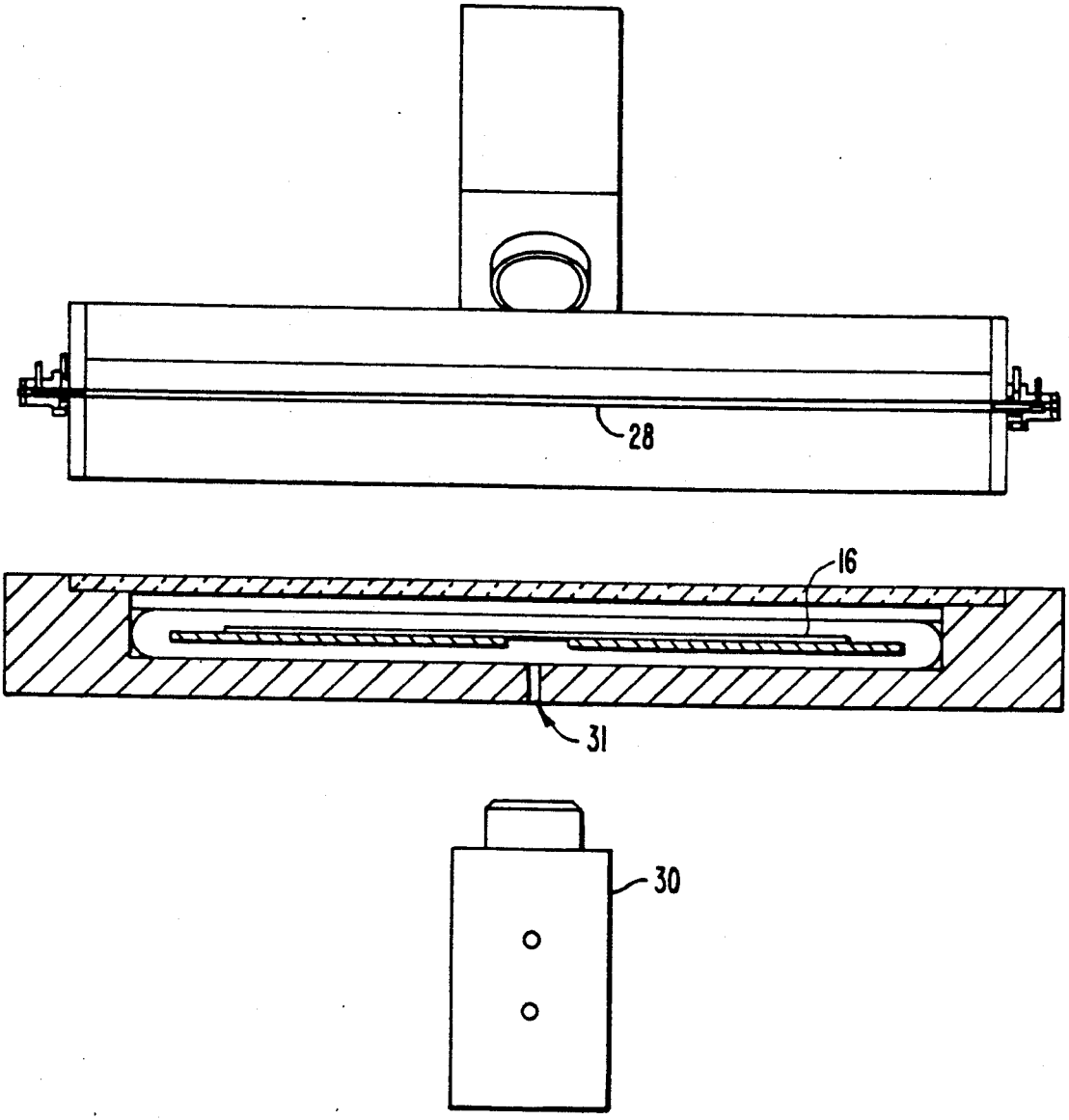

FIGS. 4A and 4B are front and side views of an alternate embodiment in which a light source 28 and pyrometer 30 are moved in alignment relative to specimen 16. Light source 28 and pyrometer 30 could be fixed, while specimen 16 is moved across the gap between them. Alternately, specimen 16 could remain still while light source 28 and pyrometer 30 are moved. A scan line defined by lines 32 illuminates a portion of specimen 16 at any one time. A longitudinal slot 31 allows light to pass to pyrometer 30.

Figure 5:
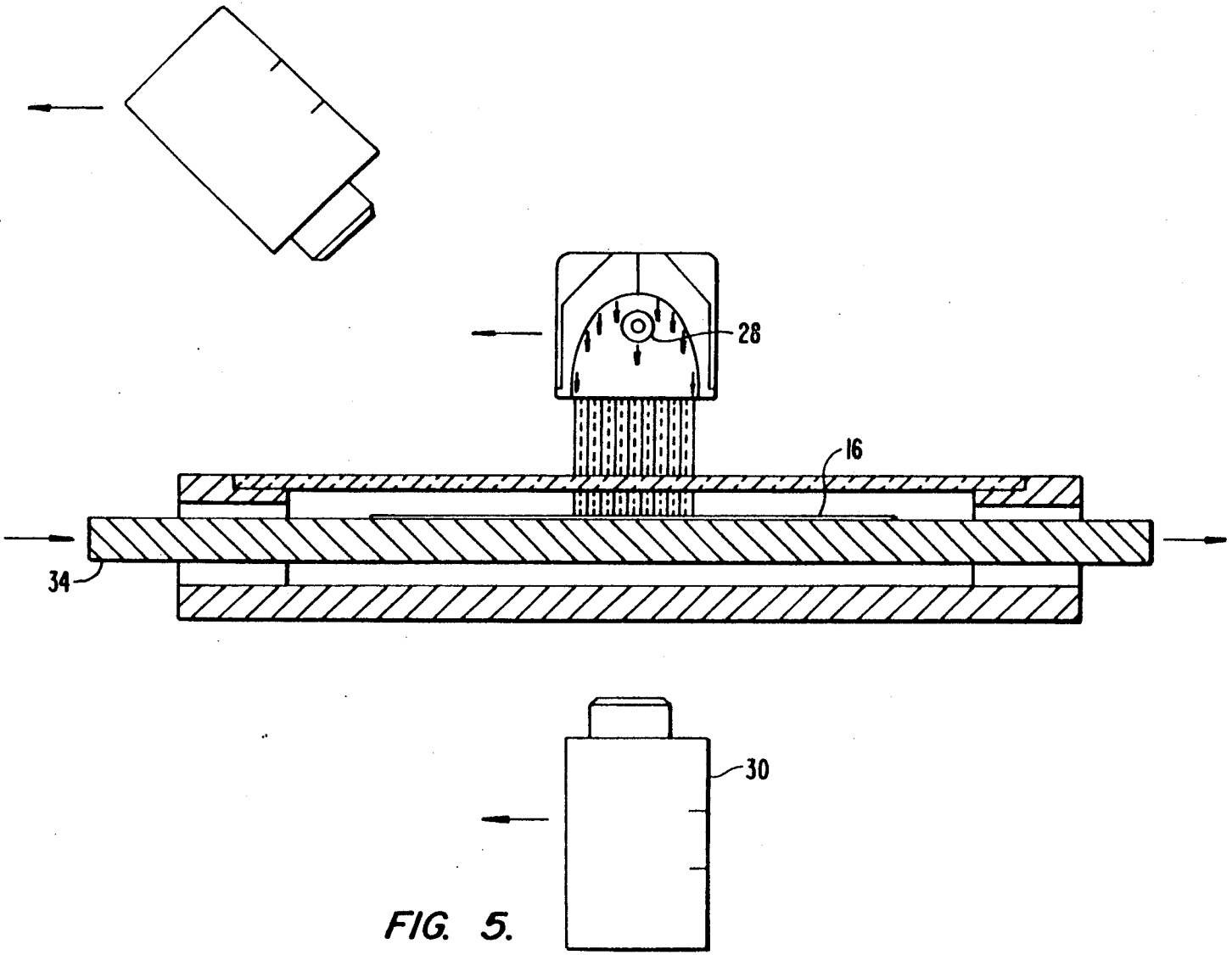
FIG. 5 is a diagram of the embodiment of FIG. 4A with a heat sink.

FIG. 5 shows the embodiment of FIG. 4A with the addition of a heat sink 34. Heat sink 34 would have a longitudinal slot to allow pyrometer 30 to view specimen 16 at all times during the relative movement.

As will be understood by those familiar with the art, the present invention may be embodied in other specific forms without departing from the spirit or essential characteristics thereof. For example, an array of lamps could be used instead of a single lamp. Accordingly, the disclosure of the preferred embodiment of the invention is intended to be illustrative, but not limiting, of the scope of the invention which is set forth in the following claims.

What is claimed is:

1. A method for selectively heating a film on a substrate, comprising the steps of:
   selecting said substrate and said film to have different light absorption characteristics;
   illuminating said film and substrate with a source of light having a peak wavelength that will be substantially absorbed by said substrate and substantially not absorbed by said film.

2. A method for selectively heating a film on a substrate, comprising the steps of:
   selecting said substrate and said film to have different light absorption characteristics;
   illuminating said film and substrate with a source of light having a peak wavelength that will be substantially absorbed by said substrate and substantially not absorbed by said film;
   wherein said substrate is silicon and said film is a liquid-based dielectric.

3. The method of claim 2 wherein said dielectric is glass.

4. The method of claim 2 further comprising the steps of:
   illuminating said film and substrate at a first intensity of light to produce a first temperature for a first period of time; and
   subsequently illuminating said film and substrate with a second intensity of light, greater than said first intensity, to heat said film and substrate at a second temperature, greater than said first temperature, for a second period of time.

5. A product made by the process of claim 1.

* * * * *